US009863115B2

(12) United States Patent
Stadler

(10) Patent No.: US 9,863,115 B2
(45) Date of Patent: Jan. 9, 2018

(54) CONTROLLED PRESSURE RELEASE MANHOLE COVER ASSEMBLY

(71) Applicant: Neenah Foundry Company, Neenah, WI (US)

(72) Inventor: David M. Stadler, Lathrup Village, MI (US)

(73) Assignee: NEENAH FOUNDRY COMPANY, Neenah, WI (US)

( * ) Notice: Subject to any disclaimer, the term of this patent is extended or adjusted under 35 U.S.C. 154(b) by 126 days.

(21) Appl. No.: 14/831,406

(22) Filed: Aug. 20, 2015

(65) Prior Publication Data

US 2016/0053457 A1 Feb. 25, 2016

Related U.S. Application Data

(60) Provisional application No. 62/070,420, filed on Aug. 22, 2014, provisional application No. 62/070,421, filed on Aug. 25, 2014.

(51) Int. Cl.
*E02D 29/14* (2006.01)

(52) U.S. Cl.
CPC ..... *E02D 29/1436* (2013.01); *E02D 29/1418* (2013.01); *E02D 29/1427* (2013.01); *E02D 29/1463* (2013.01)

(58) Field of Classification Search
CPC . E02D 29/14; E02D 29/1418; E02D 29/1427; E02D 29/1436

(Continued)

(56) References Cited

U.S. PATENT DOCUMENTS 1,955,018 A * 4/1934 Rego ..... E02D 29/14 200/61.62
2,025,839 A * 12/1935 Woods, Jr. ..... E02D 29/14 404/25

(Continued)

FOREIGN PATENT DOCUMENTS

| | | |
|---|---|---|
| AU | 2013203172 | 5/2013 |
| EP | 2 685 009 | 1/2014 |
| WO | WO-2004/018787 | 3/2004 |

OTHER PUBLICATIONS

U.S. Appl. No. 14/625,766, filed Feb. 19, 2015, Stadler, David.

(Continued)

*Primary Examiner* — Thomas B Will
*Assistant Examiner* — Katherine Chu
(74) *Attorney, Agent, or Firm* — Foley & Lardner LLP

(57) ABSTRACT

A manhole cover assembly includes a manhole cover and a latch assembly. The manhole cover is movable between a seated position in which the manhole cover is supported on a seat of a manhole frame, and an unseated position in which the manhole cover is displaced relative to the seat of the manhole frame. A shock absorber includes a housing fixedly coupled to the manhole cover. The housing defines a cylinder. A piston is slidably coupled to the cylinder. A rod is fixedly coupled to the piston. A spring is positioned within the cylinder adjacent the piston. A latch is fixedly coupled to the rod. In response to a pressure applied to the manhole cover, the latch assembly is configured to permit limited displacement of the manhole cover relative to the seat of the manhole frame, and to controllably dissipate energy relating to the pressure.

20 Claims, 10 Drawing Sheets

(58) Field of Classification Search
USPC ..... 404/25
See application file for complete search history.

(56) References Cited

U.S. PATENT DOCUMENTS

| | | | | |
|---|---|---|---|---|
| 4,461,597 | A * | 7/1984 | Laurin | E02D 29/1427 137/371 |
| 5,062,735 | A | 11/1991 | Gaudin | |
| 5,082,392 | A * | 1/1992 | Marchese | E02D 29/1427 404/25 |
| 5,511,575 | A * | 4/1996 | Andenmatten | B60P 3/224 137/202 |
| 6,350,081 | B1 * | 2/2002 | Khajavi | E02D 29/1436 404/25 |
| 6,551,015 | B1 * | 4/2003 | Khajavi | E02D 29/1436 404/25 |
| 6,739,796 | B1 * | 5/2004 | Del Nero | E02D 29/1427 404/25 |
| 6,764,261 | B1 * | 7/2004 | Stadler | E02D 29/1427 411/340 |
| 7,171,994 | B1 | 2/2007 | O'Brien | |
| 7,484,908 | B2 * | 2/2009 | Stadler | E02D 29/1418 404/25 |
| 7,704,010 | B2 * | 4/2010 | Nolle | E02D 29/14 404/25 |
| 7,712,995 | B2 * | 5/2010 | Stadler | E02D 29/1427 404/25 |
| 7,748,927 | B2 | 7/2010 | Neathery | |
| 7,891,904 | B2 * | 2/2011 | Stadler | E02D 29/1427 404/25 |
| 8,784,000 | B2 | 7/2014 | Reynolds et al. | |
| 8,794,865 | B2 | 8/2014 | Stadler | |
| 9,004,810 | B2 | 4/2015 | Reynolds et al. | |
| 9,416,516 | B2 * | 8/2016 | Stadler | E02D 29/1418 |
| 2007/0223997 | A1 * | 9/2007 | Fuchs | E02D 29/1427 404/25 |
| 2010/0028077 | A1 | 2/2010 | Stadler | |
| 2012/0087724 | A1 * | 4/2012 | Nolle | E02D 29/1427 404/25 |
| 2013/0212945 | A1 * | 8/2013 | Lanham | E05F 15/60 49/25 |
| 2013/0221688 | A1 * | 8/2013 | Stadler | E02D 29/1427 292/155 |
| 2014/0169876 | A1 | 6/2014 | Reynolds et al. | |

OTHER PUBLICATIONS

European Search Report Issued for European Patent Application No. 15182087.5, dated Dec. 22, 2015, 4 pages.
U.S. Appl. No. 62/090,018, filed Dec. 10, 2014, Stadler, David M.
U.S. Appl. No. 61/974,626, filed unknown, Stadler, David M.

* cited by examiner

CONTROLLED PRESSURE RELEASE MANHOLE COVER ASSEMBLY

CROSS-REFERENCE TO RELATED PATENT APPLICATIONS

The present application claims priority to U.S. Provisional Patent Application No. 62/070,420, filed Aug. 22, 2014 and U.S. Provisional Patent Application No. 62/070,421, filed Aug. 25, 2014. The contents of the aforementioned applications are incorporated herein by reference in their entireties and for all purposes.

TECHNICAL FIELD

The present disclosure relates generally to the field of manhole cover assemblies.

BACKGROUND

A manhole provides access to an underground passage or confined area. The underground passage or confined area may contain public utility equipment, such as sewer lines, storm drains, electrical and telecommunication cables, etc. A manhole cover is a removable plate that forms a lid over the opening of a manhole. Manhole covers are used to prevent individuals and objects from falling into the manhole, as well as to prevent unauthorized access into the manhole.

Manhole covers are conventionally formed of cast iron, which makes them inexpensive, strong, and heavy, usually weighing more 100 pounds. The weight helps to keep them in place when traffic passes over them, and makes it difficult for unauthorized individuals to remove them. In addition to being constructed of cast iron, manhole covers may also be constructed of concrete, glass-reinforced plastic or other composite materials, and other materials, or any combination thereof.

Despite their significant weight, manhole covers can be dislodged in several ways. For example, an explosion within a manhole can cause a sudden pressure buildup that can dislodge the manhole cover. For example, gases (e.g., methane from sewage or natural gas from a leaking natural gas line) can become trapped in the space within the manhole, as well as within the passages or spaces connected to the manhole. The gas may be ignited, for example, due to a spark from a frayed power cable. Some explosions generate sufficient pressure to dislodge the manhole from its frame. However, higher-intensity explosions may propel the manhole cover up to 20 feet or more into the air. A heavy manhole cover flying through the air can be extremely dangerous or deadly. In addition to the human and property damage risk, individuals or objects may subsequently fall into the now-uncovered manhole.

Excessive rainfall and flooding can also dislodge manhole covers. For example, storm drain systems may become overfilled during periods of excessive rainfall. Water may flow through the storm drain systems and up through a manhole. Sufficient pressure from the water may dislodge manhole covers and "float" them away. The now-uncovered manhole can be obscured by dirty water, thereby providing a dangerous risk that an unwary victim may inadvertently fall into the manhole and into the storm drain system.

SUMMARY

Various embodiments relate to manhole cover assemblies. An example manhole cover assembly includes a manhole cover and a latch assembly. The manhole cover is movable between a seated position in which the manhole cover is supported on a seat of a manhole frame, and an unseated position in which the manhole cover is displaced relative to the seat of the manhole frame. A latch shock absorber of the latch assembly includes a latch housing fixedly coupled to the manhole cover. The latch housing defines a latch cylinder. A latch piston is slidably coupled to the latch cylinder. A latch rod is fixedly coupled to the latch piston. The latch rod extends through the latch housing. A latch spring is positioned within the latch cylinder adjacent the latch piston. A latch is fixedly coupled to the latch rod. In response to a pressure applied to the manhole cover, the latch assembly is configured to permit limited displacement of the manhole cover relative to the seat of the manhole frame, and to controllably dissipate energy relating to the pressure.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Various events, such as explosions or flooding, can cause a sudden pressure increase beneath a manhole cover, which can force the manhole cover from its frame. Several manhole cover assemblies have been developed to release pressure buildup from beneath a manhole cover while limiting displacement of the manhole cover relative to its frame. For example, some manhole cover assemblies include legs or other features to permit limited displacement of the manhole cover. During a pressure-inducing event, the legs contact a bottom surface of the frame, thereby limiting travel of the manhole cover. However, the kinetic energy of the rising manhole cover is concentrated into relatively small areas of the frame surface that are contacted by the legs. Accordingly, significant pressure-inducing events, such as explosions or floods, may damage the frame. This is undesirable because the frame is typically cemented or otherwise permanently fixed in a street or roadway, and removal and replacement of the frame is a significant and costly undertaking.

Figure 1:
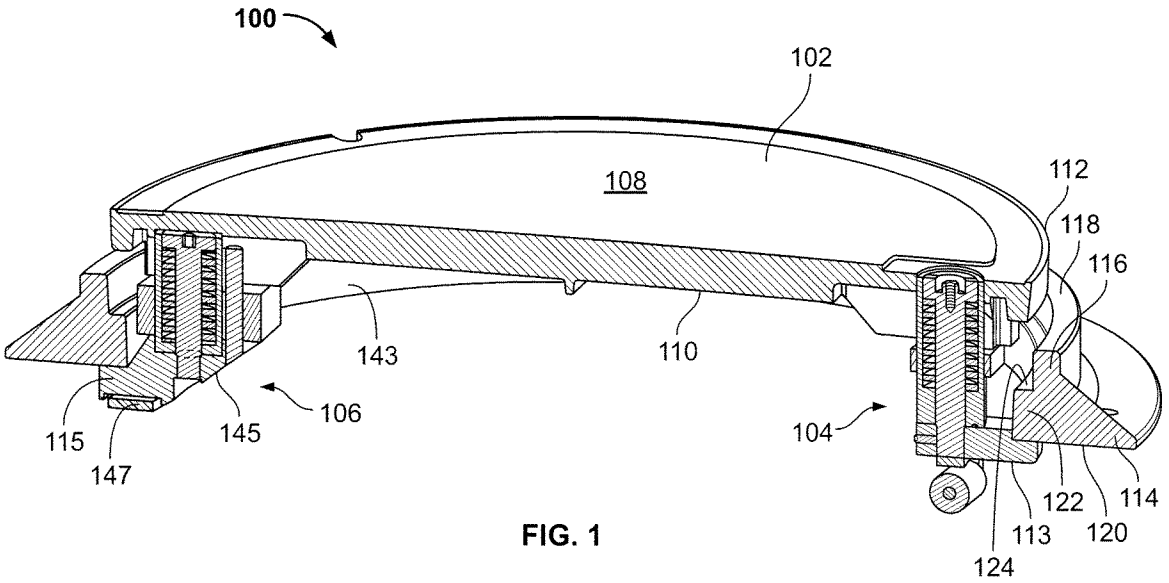
FIG. 1 is a cross-sectional view of a manhole cover assembly, according to an embodiment.

FIG. 1 is a cross-sectional view of a manhole cover assembly 100, according to an embodiment. As shown in FIG. 1 the manhole cover assembly 100 includes a manhole cover 102, a latch assembly 104, and a lug assembly 106. The manhole cover 102 is generally disc-shaped, having a top surface 108, a bottom surface 110 and an outer periphery 112. The latch assembly 104 and the lug assembly 106 are each securely coupled (e.g., bolted, welded, etc.) to the bottom surface 110 of the manhole cover 102. The latch assembly 104 includes a latch 113 extending radially outward from the latch assembly 104. Similarly, the lug assembly 106 includes a lug 115 extending radially outward from the lug assembly 106.

A frame 114 is configured to support the manhole cover 102 over the opening of a manhole (not shown). The frame 114 is fixedly secured (e.g., cemented or otherwise fixed) within a substrate (e.g., street, road, sidewalk, etc.) defining the opening of the manhole (not shown). The frame 114 is generally ring-shaped, having a peripheral wall 116 extending between an upper surface 118 and an opposite lower surface 120. The peripheral wall 116 has an inner diameter that is slightly larger than an outer diameter of the manhole cover 102. In operation, the upper surface 118 of the frame 114 is generally flush with the road or other surface that defines the manhole.

The frame 114 also includes a seat 122 that extends radially inward from the peripheral wall 116. The seat 122 is structured to support the manhole cover 102 within the frame 114. More specifically, the bottom surface 110 of the manhole cover 102 proximate the outer periphery 112 rests on, and is supported by, a top surface 124 of the seat 122 when the manhole cover is in a seated position. The top surface 108 of the manhole cover 102 is generally flush with the upper surface 118 of the frame 114 when the manhole cover 102 is in the seated position.

Figure 2:
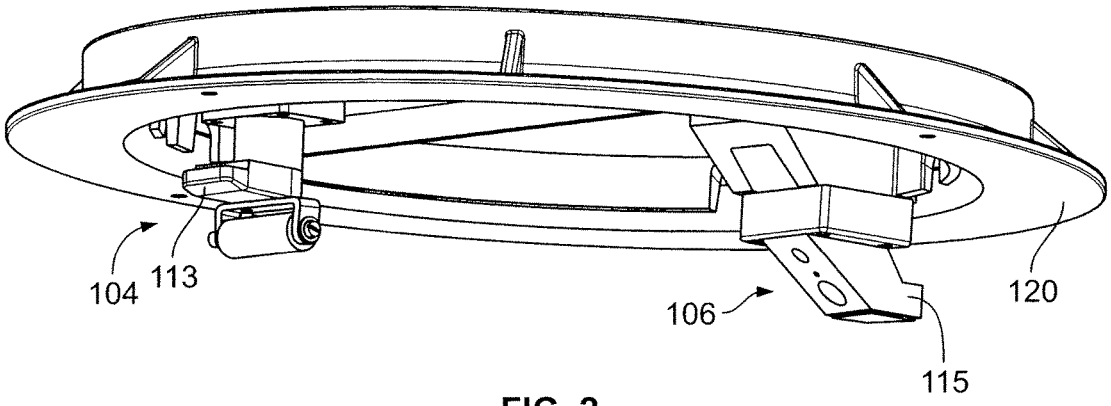
FIG. 2 is a bottom perspective view of the manhole cover assembly of FIG. 1, with the manhole cover in a seated position.

FIG. 2 is a bottom perspective view of the manhole cover assembly 100 of FIG. 1, with the manhole cover 102 in the seated position. As shown in FIG. 2, when the manhole cover 102 is in the seated position, as is typically the case, there is a gap between the bottom surface 120 of the frame 114 and each of the latch 113 and the lug 115. A sudden pressure increase against the bottom surface 110 of the manhole cover 102 can cause the manhole cover 102 to move relative to the frame 114 from the seated position (e.g., as shown in FIG. 2) to the unseated position (e.g., as shown in FIG. 1). Returning to FIG. 1, it can be seen that in the unseated position, the latch 113 and the lug 115 each contact the bottom surface 120 of the frame 114. Accordingly, the latch and lug assemblies 104, 106 are configured to limit displacement of the manhole cover 102 during a pressure-inducing event in which the manhole cover 102 is forced to the unseated position.

The latch and lug assemblies 104, 106 are also configured to controllably dissipate pressure from within the manhole during a pressure-inducing event. As discussed in further detail below, the latch and lug assemblies 104, 106 each include shock absorbers that are configured to absorb the energy of the moving manhole cover 102 when the manhole cover 102 is in the unseated position. Accordingly, energy from the pressure-inducing event is absorbed by the latch and lug assemblies 104, 106, rather than being abruptly transmitted to the frame 114. The shock absorbers of the latch and lug assemblies 104, 106, as well as gravity, operate to reseat the manhole cover 102 within the frame 114 once the pressure within the manhole has dissipated. Thus, in response to a pressure-inducing event, the latch and lug assemblies 104, 106 of the manhole cover assembly 100 operate to controllably release pressure from within a manhole. In doing so, the latch and lug assemblies 104, 106 prevent the manhole cover 102 from being launched from the frame 114, while also preventing damage to the frame 114 and the surface (e.g., street) to which the frame is secured.

Figure 3:
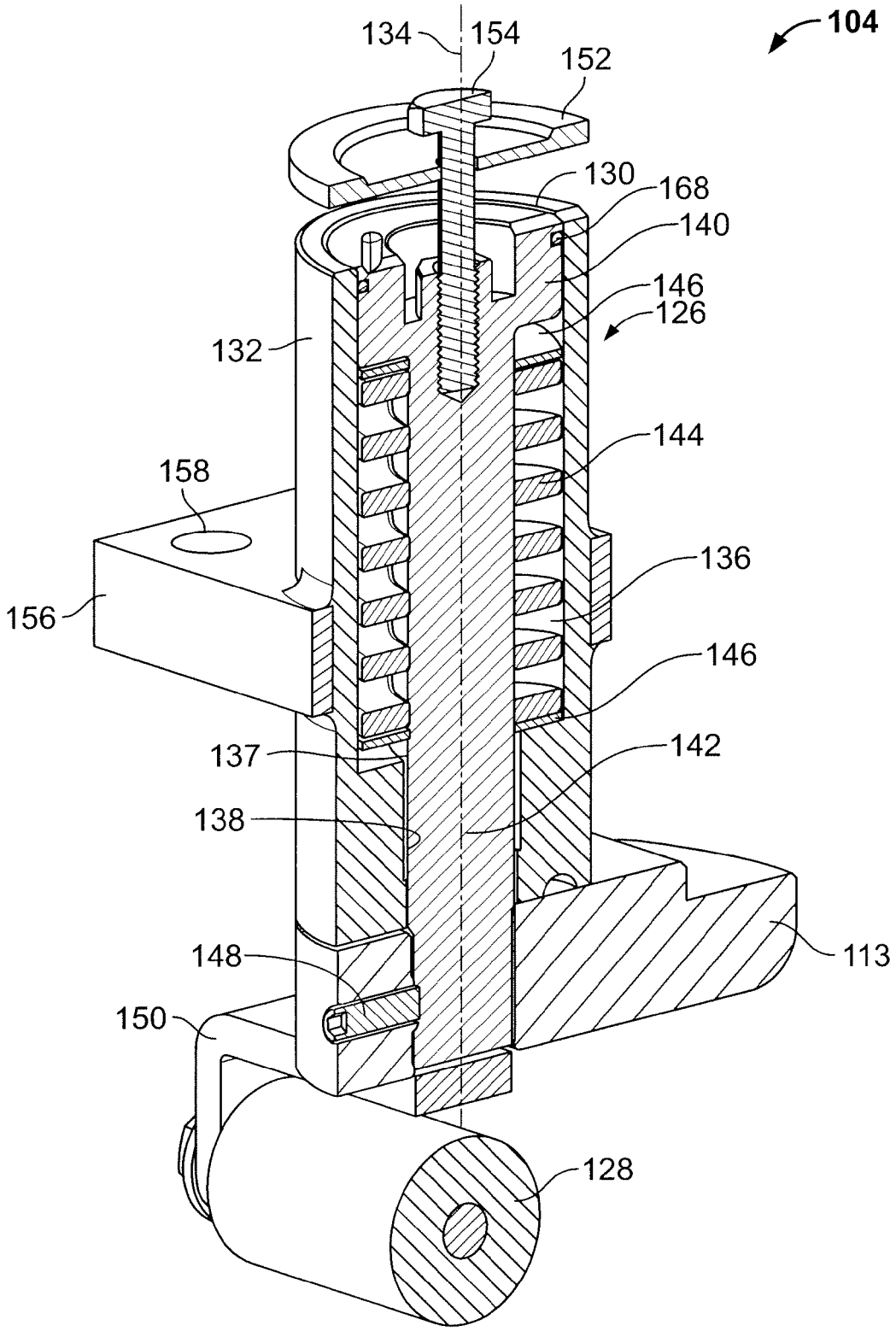
FIG. 3 is a cross-sectional view of the latch assembly of the manhole cover assemblies of FIGS. 1 and 2.

FIG. 3 is a cross-sectional view of the latch assembly 104 of FIGS. 1 and 2. The latch assembly 104 includes a latch shock absorber 126, a latch 113, and a roller 128. The latch shock absorber 126 includes a housing 132 having a longitudinal axis 134. A first bore 130 extending along the longitudinal axis 134 partially through the housing 132 defines a latch cylinder 136 of the latch shock absorber 126. A second bore 137 extending along the longitudinal axis 134 through the housing 124 defines a latch passage 138.

The latch shock absorber 126 also includes a latch piston 140 positioned within the cylinder 136. A latch rod 142 is coupled to the latch piston 140 and extends along the longitudinal axis 134, through the latch passage 138. In some embodiments, the latch piston 140 and the latch rod 142 are formed from an integral member. However, in other embodiments, the latch piston 140 and the latch rod 142 are discrete components that are coupled together. The latch passage 138 is slightly larger than the diameter of the latch rod 142 so as to enable the latch rod 142 to rotate within the latch passage 138. A latch spring 144 is positioned within the latch cylinder 136. In one embodiment, the latch spring 144 is a die spring. In some embodiments, wave washers 146 are positioned adjacent each end of the latch spring 144. When assembled, the latch spring 144 and the wave washers 146 are compressed by the latch piston 140.

The latch 113 is fixedly coupled to the latch rod 142 via a set screw 148 that extends through the latch 113 and into the latch rod 142. Additionally or alternatively, the latch 113 may be coupled to the latch rod 142 via a threaded coupling between the latch rod 142 and the latch 113, a press-fit coupling, a welded joint, etc. The latch 113 is selectively rotatable relative to the housing 132 about the longitudinal axis 134, between a locked position and an unlocked position, via rotation of the latch piston 140. In other words, the latch 113 is rotatably coupled to the housing 132 via the latch piston 140 and the latch rod 142. In the locked position, the latch 113 extends radially outward relative to the manhole cover 102. In the unlocked position, the latch 113 extends radially inward relative to the manhole cover 102.

The roller 128 is coupled to the latch 113 via a roller bracket 150. As discussed in further detail below, the roller 128 facilitates removal of the manhole cover 102 from the frame 114. More particularly, the manhole cover 102 may be raised out of the frame 114 and lowered such that the roller 128 contacts the street surface. The roller 128 allows the manhole cover 102 to be easily rolled away from the frame 114 to provide access to the manhole. As the manhole cover 102 is rolled away from the frame 114, extractor rails 143 (FIG. 1) formed on the bottom surface 110 of the manhole cover 102 slide against the upper surface 118 of the peripheral wall 116 of the frame 114. As the manhole cover 102 continues to be rolled away from the frame 114, an angled surface 145 of the lug assembly 106 slides against the upper surface 118 of the peripheral wall 116 of the frame 114. As the manhole cover 102 is completely removed from the frame 114, a skid pad 147 affixed (e.g., bolted) to a bottom surface of the lug assembly 106 contacts the outer surface (e.g., roadway). The skid pad 147 may be formed of Teflon, rubber, or other materials.

An impact recording disc 152 is removably coupled to the latch piston 140 via an impact recording fastener 154. As discussed in further detail below, the impact recording disc 152 is configured to measure and record the severity of a pressure-inducing event.

A latch mounting plate 156 is fixedly coupled to, and extends radially outward from, the housing 132. The latch mounting plate 156 defines one or more bores 158, each being configured to receive a fastener to mount the latch assembly 104 to the manhole cover 102.

Figure 4:
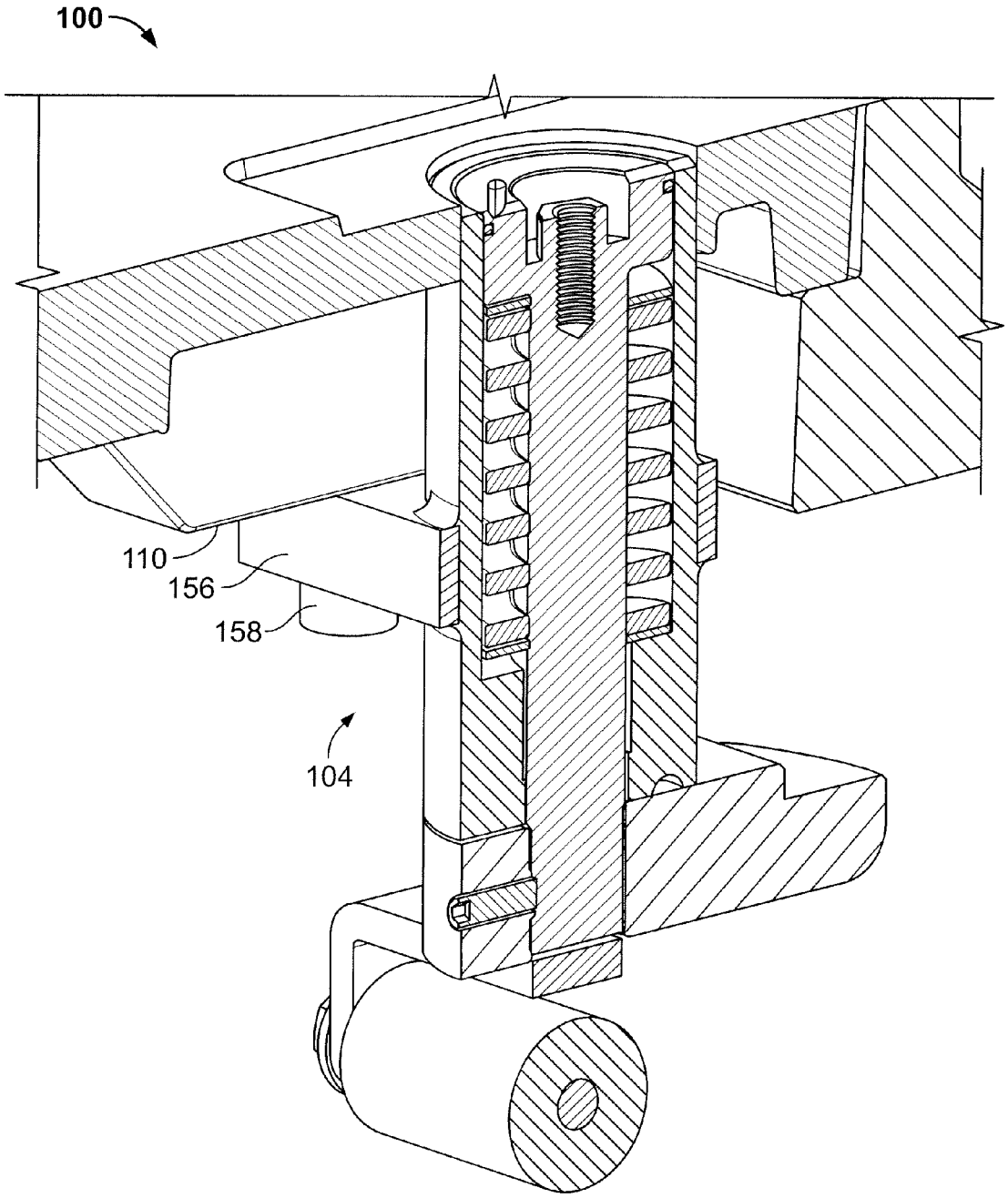
FIG. 4 is a partial cross-sectional view of the manhole cover assembly of FIGS. 1 and 2, including the latch assembly mounted to the manhole cover.

FIG. 4 is a partial cross-sectional view of the manhole cover assembly 100 of FIGS. 1 and 2, including the latch assembly 104 of FIGS. 1-3 mounted to the manhole cover 102. As shown in FIG. 4, the latch mounting plate 156 is mounted to the bottom surface 110 of the manhole cover 102 via latch mounting bolts 158. Accordingly, upon installing the manhole cover 102 within the frame 114, the latch assembly 104 is not accessible—and therefore may not be unlawfully removed—by a potential thief.

Figure 5:
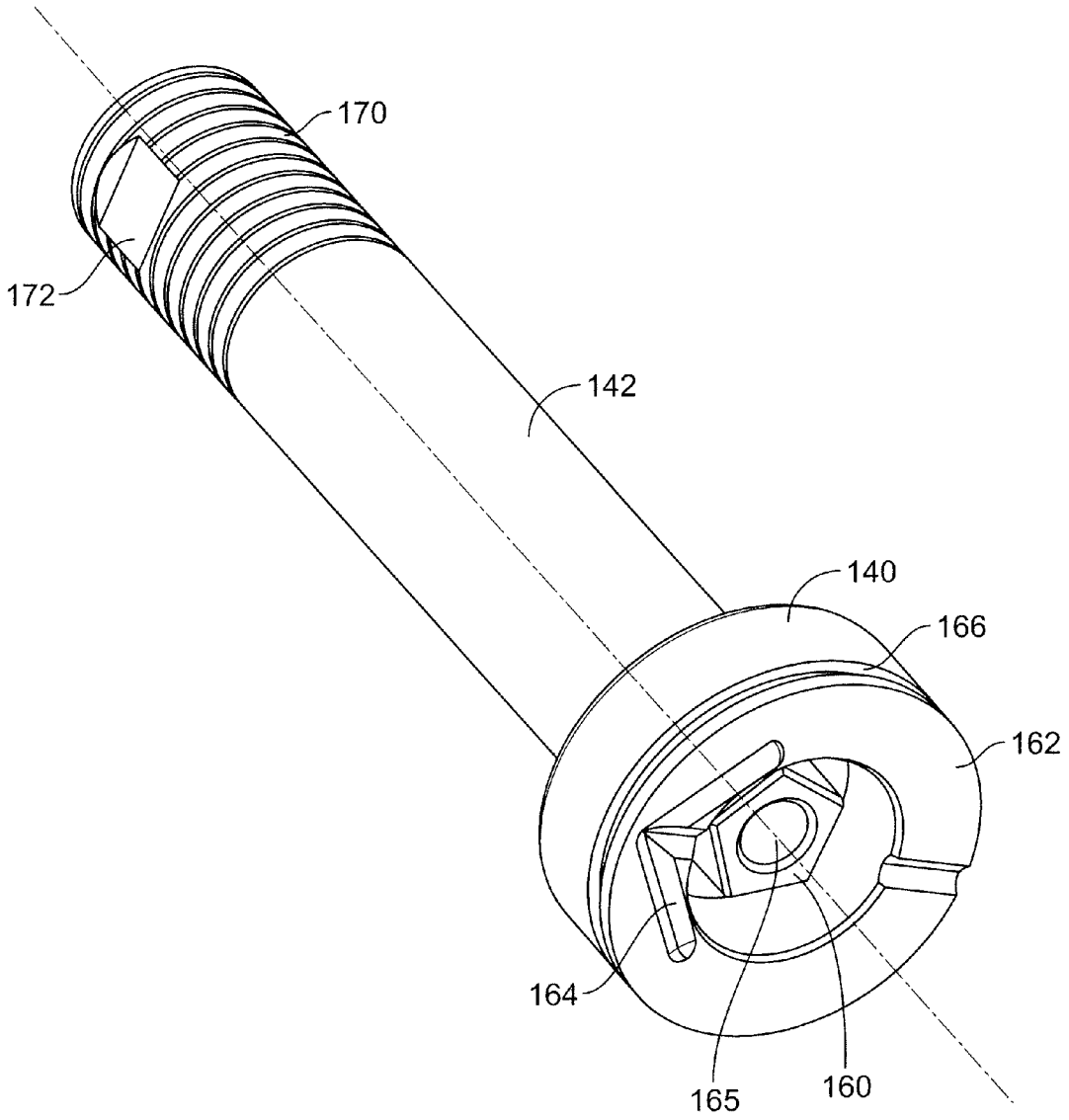
FIG. 5 is a top perspective view of the latch piston and latch rod of FIGS. 3 and 4.

FIG. 5 is a top perspective view of the latch piston 140 and latch rod 142 of FIGS. 3 and 4. The latch piston 140 includes a tamper-resistant boss 160 positioned within a cavity extending longitudinally inward from an outer surface 162 of the latch piston 140. The latch piston 140 may be rotated via engagement with the tamper-resistant boss 160. In one embodiment, a latch position indicator 164 is formed in the outer surface 162 of the latch position 140 so as to indicate the rotational position of the latch piston 140 relative to the housing 132, and thereby also indicate the rotational position of the latch 113 (FIGS. 1-4).

As illustrated in FIG. 5, according to one embodiment, the tamper-resistant boss 160 includes a pentagonal (i.e., five-sided) projection, which is configured to be engaged only by a specialty tool, such as a non-standard socket. Accordingly, unauthorized users or vandals are prevented from rotating the tamper-resistant boss so as to unlock and remove the manhole cover 102. In other embodiments, the tamper-resistant boss 160 includes different shapes or geometric features, which may be standard or non-standard. Various tamper-resistant features may be used in addition to or instead of the tamper-resistant boss 160 to deter tampering or theft. An impact recording bore 165 extends longitudinally inward from the tamper-resistant boss 160 along the longitudinal axis 134. The impact recording bore 165 may be configured to threadedly receive the impact recording fastener 154 (FIG. 3) to secure the impact recording disc 152 to the latch piston 140.

An o-ring groove 166 is formed in an outer surface of the latch piston 140. The o-ring groove 166 is configured to receive an o-ring 168 (FIG. 3), which may operate to seal the latch piston 140 against the cylinder 136. Accordingly, the water and debris are prevented from entering the cylinder 136, so as to prevent corrosion or other damage to the spring 144 or other components of the latch assembly 104. The o-ring 168 may also fluidly seal the cylinder 136 so as to seal the air within the cylinder 136. As will be appreciated, air trapped within the cylinder 136 may operate as a spring and/or a damper when the air is compressed within the cylinder 136 by the latch piston 140 during pressure-inducing events, thereby operating to dissipate the energy from the pressure-inducing events. It should be understood that the cylinder 136 may not be completely (e.g., heremetically) sealed. For example, some air may escape through the latch passage 138. In addition, some air may escape past the o-ring 168, albeit less freely than if the o-ring 168 was excluded. However, the latch assembly 104 implements the restricted air flow path for air exiting the cylinder 136, thereby utilizing the compressive properties of air to assist in dissipating and damping energy from pressure-inducing events. In some embodiments, the amount of air restriction may be tuned (e.g., by changing clearances between components) to particular desirable operating characteristics.

The latch rod 142 may include a threaded end 170 configured to engage a bore in the latch 113. Further, a recess 172 may be formed in the threaded end 170 of the latch rod 142 so as to engage the set screw 148 to fixedly couple the latch 113 to the latch rod 142.

Figure 6:
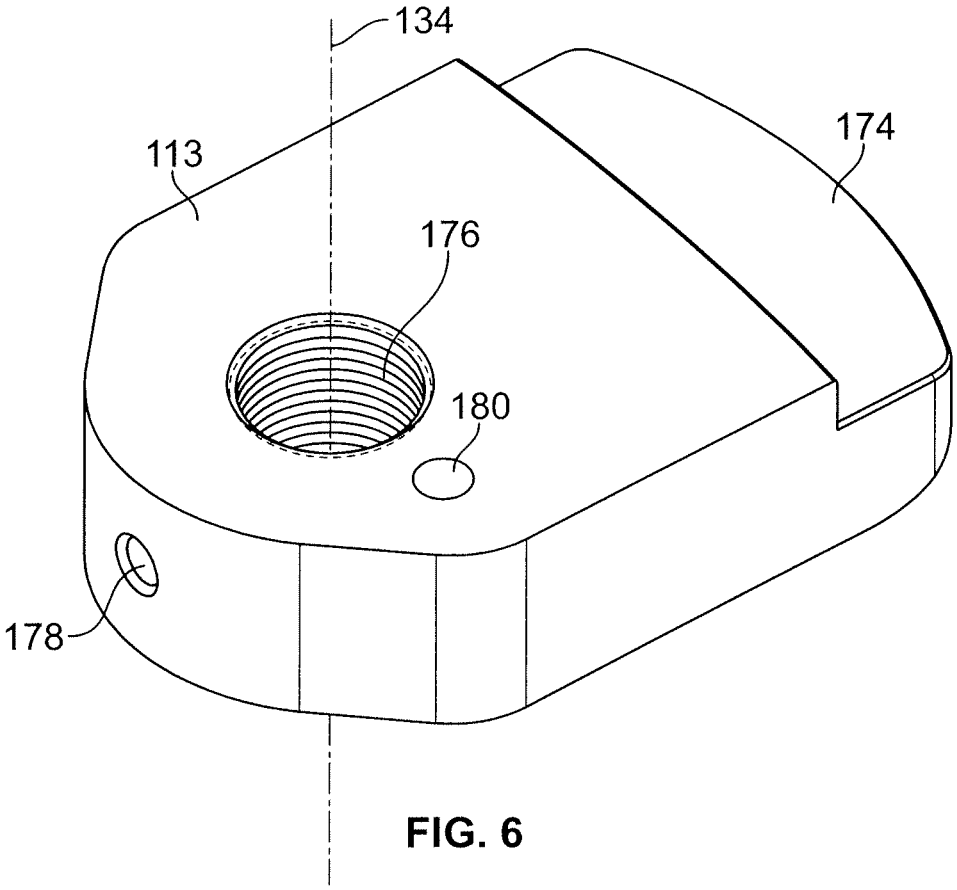
FIG. 6 is a perspective view of the latch of FIGS. 1-5.

FIG. 6 is a perspective view of the latch 113 of FIGS. 1-5. In some embodiments, as shown in FIG. 6, the latch 113 defines a stop 174. The stop 174 is structured to contact the lower surface 120 of the frame 114 when the manhole cover 102 is in the unseated position. In some embodiments, the stop 174 is recessed from the remainder of the latch 113.

The latch 113 defines a first bore 176 that extends through the latch 113 along the longitudinal axis 134. The first bore 176 is structured to receive the threaded end 170 of the latch rod 142. The latch 113 also defines a second bore 178 extending transverse to the longitudinal axis 134, from a surface opposite the stop 174 to the first bore 176. As shown more clearly in FIGS. 3-4, the second bore 178 extends through the latch 113 to the first bore 176. The second bore 178 is structured to receive the set screw 148. The set screw 148 may engage the latch rod 142 to fixedly couple the latch 113 to the latch rod 142. The latch 113 also defines a third bore 180 extending into the latch 113 along an axis parallel with the longitudinal axis 134, and spaced radially outward from the first bore 176. The third bore 180 is structured to receive a detent pin (not shown), as discussed further below in connection with FIG. 7.

Figure 7:
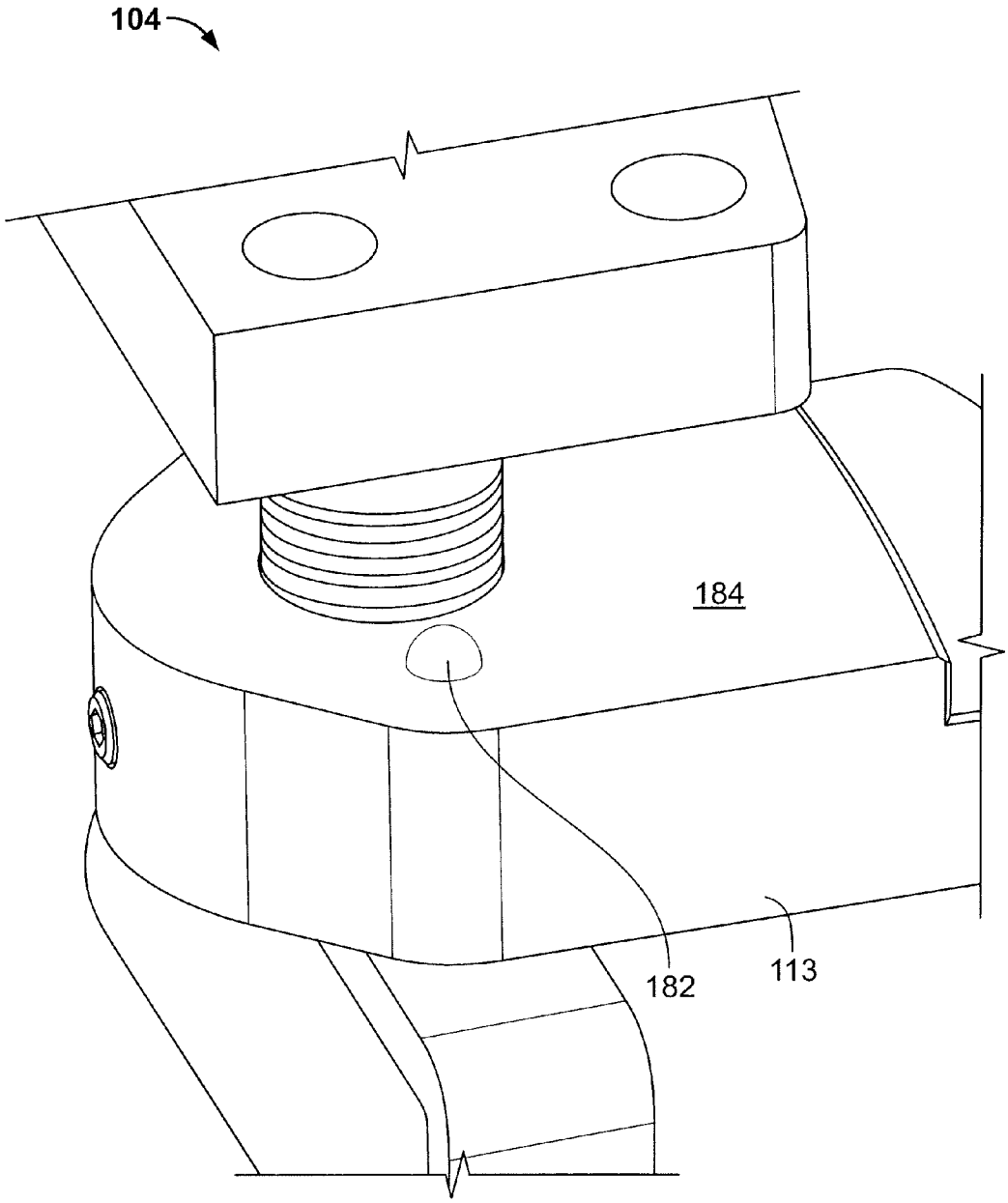
FIG. 7 is a partial top perspective view of the latch assembly of FIGS. 1-4, with the housing hidden.

FIG. 7 is a partial top perspective view of the latch assembly 104 of FIGS. 1-4, with the housing 132 hidden. As shown in FIG. 7, a detent pin 182 is positioned in the third bore 180 of the latch 113, and extends above a top surface 184 of the latch 113. The detent pin 182 may be fixedly coupled to the latch 113 via a press-fit or threaded connection, for example. In other embodiments, the latch 113 does not include the third bore 180 and the detent pin 182 is instead machined or otherwise formed into the latch 113. In other embodiments, the latch assembly 104 may include more than one detent pin 182 and corresponding detents. For example, the latch assembly 104 may include two detent pins 182 spaced 180 degrees apart. In some situations, this configuration may be desirable to improve the detent engagement function and feel.

Figure 8:
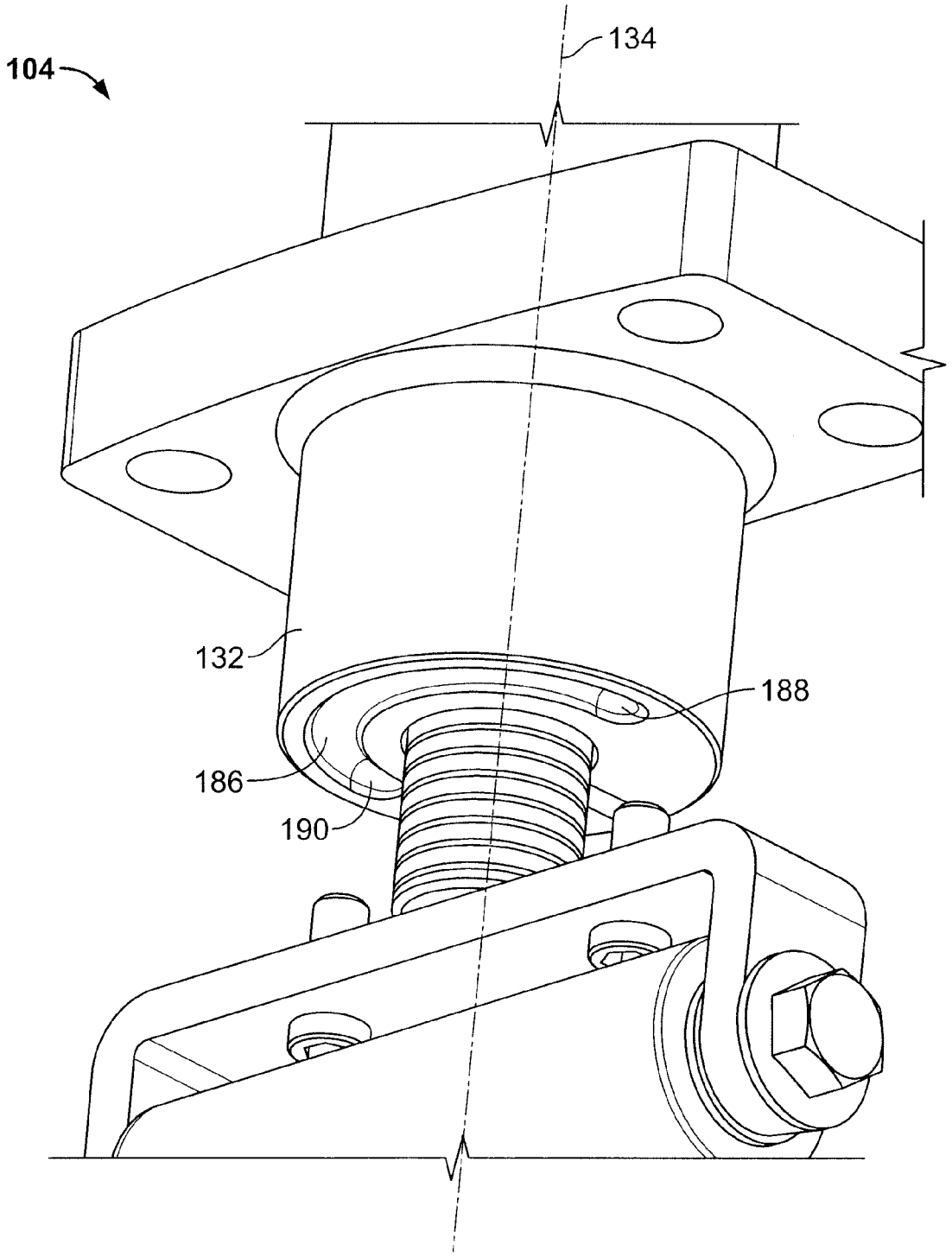

FIG. 8 is a partial bottom perspective view of the latch assembly 104 of FIGS. 1-4 and 7, with the latch 113 hidden. As shown in FIG. 8, the housing 132 defines a detent groove 186 in a bottom surface 168 of the housing 132. The detent groove 186 includes first and second detents 188, 190. The first and second detents 188, 190 are recessed deeper than the detent groove 186. According to an embodiment, the first and second detents 188, 190 are spaced 180 degrees from each other, about the longitudinal axis 134. In other embodiments in which multiple detent pins 183 are included, the detent groove 186 may extend along the housing 132 in a continuous circular groove.

The first detent 188 is configured to receive the detent pin 182 when the latch 113 is in the locked position, and the second detent 190 is configured to receive the detent pin 182 when the latch 113 is in the unlocked position. Because the detent groove 186 is not as deep as the first and second detents 188, 190, the detent pin 182 operates to force the latch 113 away from the housing 132 when the latch 113 is being rotated between the locked and unlocked positions. The latch piston 140 is also forced downward relative to the housing 132 in connection with the movement of the latch 113. The relative movement between the latch piston 140 and the housing 132 operates to compress the wave washers 146. Compressing the wave washers 146 may take a considerable amount of force. Accordingly, the first and second detents 188, 190, in cooperation with the detent pin 182, operate to positively establish the respective locked and unlocked positions of the latch 113.

Figure 9:
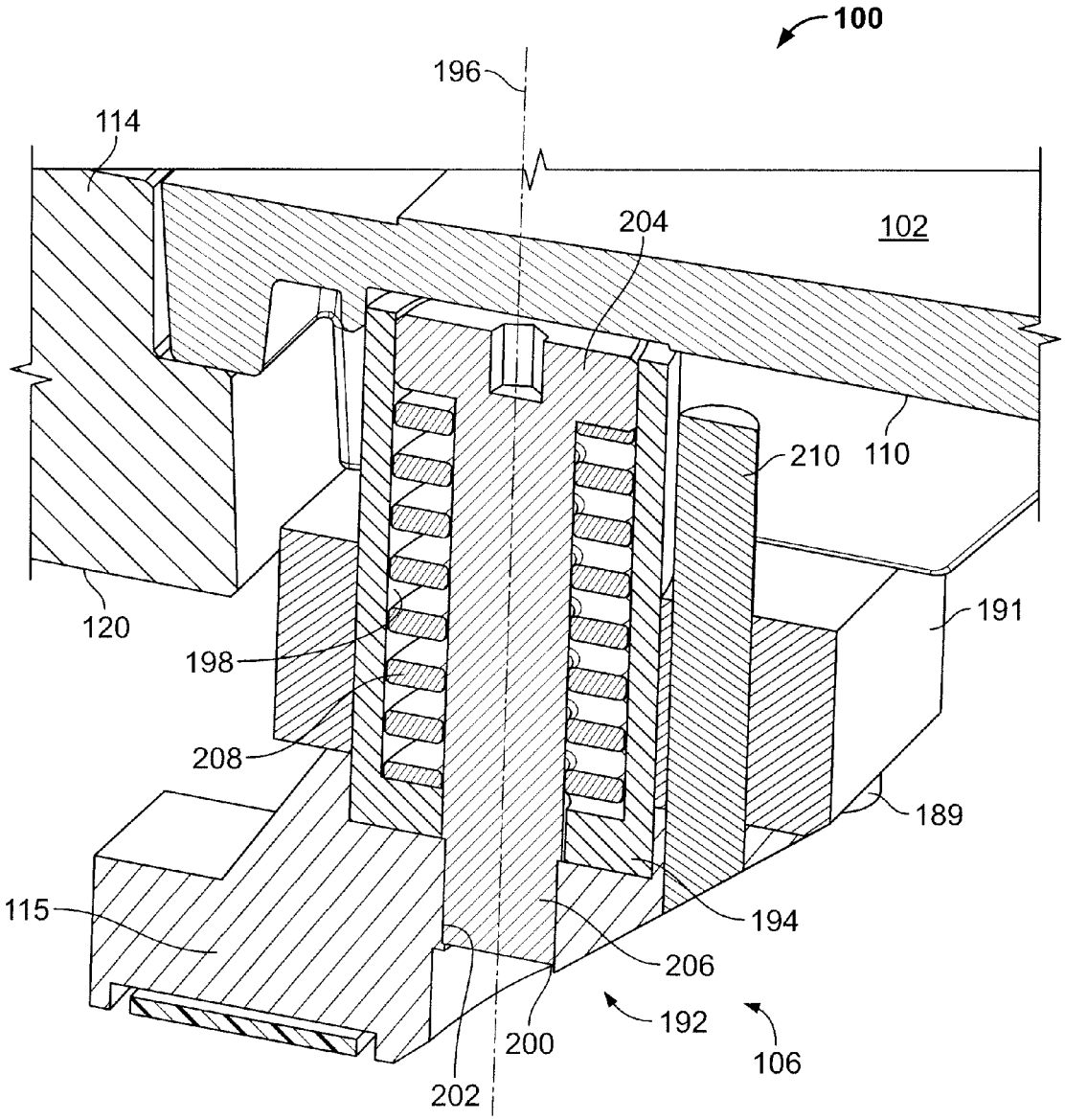
FIG. 9 is a partial cross-sectional view of the manhole cover assembly of FIGS. 1 and 2, including the lug assembly mounted to the manhole cover.

FIG. 9 is a partial cross-sectional view of the manhole cover assembly 100 of FIGS. 1 and 2, including the lug assembly 106 mounted to the manhole cover 102 via a lug mounting bolt 189 extending through a lug mounting bracket 191 and into the manhole cover 102. Similar to the latch assembly 104, the lug assembly 106 includes a lug shock absorber 192 and the lug 115. The lug shock absorber 192 includes a housing 194 having a longitudinal axis 196. A first bore extending along the longitudinal axis 196 partially through the housing 194 defines a lug cylinder 198 of the lug shock absorber 192. A second bore 200 extending along the longitudinal axis 196 through the housing 194 defines a lug passage 202.

A lug piston 204 is positioned within the lug cylinder 198, and a lug rod 206 coupled to the lug piston 204 extends along the longitudinal axis 196, through the lug passage 202. A lug spring 208 is positioned within the lug cylinder 198. In one embodiment, the lug spring 208 is a die spring. The lug 115 is fixedly coupled to the lug rod 206. Unlike the latch 113, the lug 115 is not rotatable relative to the lug housing 194. A lug alignment pin 210 extends through the lug 115, the lug mounting plate 191, and into the manhole cover 102, thereby securing the alignment of the lug 115.

In operation, the manhole cover 102 is normally in a seated position, with the bottom surface 110 of the manhole cover 102 resting on the top surface 124 of the seat 122. A pressure-inducing event causes a sudden pressure increase against the bottom surface 110 of the manhole cover 102. The sudden pressure increase forces the manhole cover 102 away from the seat 122, moving the manhole cover 102 towards the unseated position. As the manhole cover 102 continues to move away from the seat 122, the latch 113 and the lug 115 each contact the lower surface 120 of the frame 114. The momentum of the manhole cover 102 continues to force the manhole cover 102 away from the seat 122. Upon the latch 113 and the lug 115 contacting the frame 114, the shock absorbers 126, 192 of the respective latch and lug assemblies 104, 106 dissipate the energy of the moving manhole cover 102, thereby limiting displacement of the manhole cover 102, while controllably releasing the pressure from the pressure-inducing event. More specifically, as the manhole cover 102 continues to move away from the seat 122, the pistons 140, 204 of the respective latch and lug assemblies 104, 106 are displaced relative to the housings 132, 194. The springs 144, 208, as well as the air within the cylinders 136, 198 of the respective latch and lug assemblies 104, 106 are compressed by the movement of the pistons 140, 204. Accordingly, the tremendous energy of the moving manhole cover 102 is absorbed by the compression of air and the compression of the springs 144, 208. When the pressure subsides, the compressed springs 144, 208 force the manhole cover 102 back against the seat 122 and into the seated position.

During the pressure-inducing event, the impact recording disc 152 is configured to measure and record the severity of the pressure-inducing event. For example, during a pressure-inducing event, the latch piston 140 is forced away from the manhole cover 102. According to an embodiment, the displacement of the manhole cover 102 relative to the frame 114 is proportional (e.g., directly or indirectly) to the force exerted against the manhole cover 102. Because the impact recording disc 152 is supported only peripherally on the housing 132, the impact recording fastener 154 forces the center of the impact recording disc 152 downward as the latch piston 140 is forced away from the manhole cover 102, thereby plastically deforming the impact recording disc 152. More specifically, a concave depression is formed in the impact recording disc 152. After a pressure-inducing event, the depth of the depression in the impact recording disc 152 may be measured, and the measured depth may be correlated to a force exerted on the latch 113.

Figure 10:
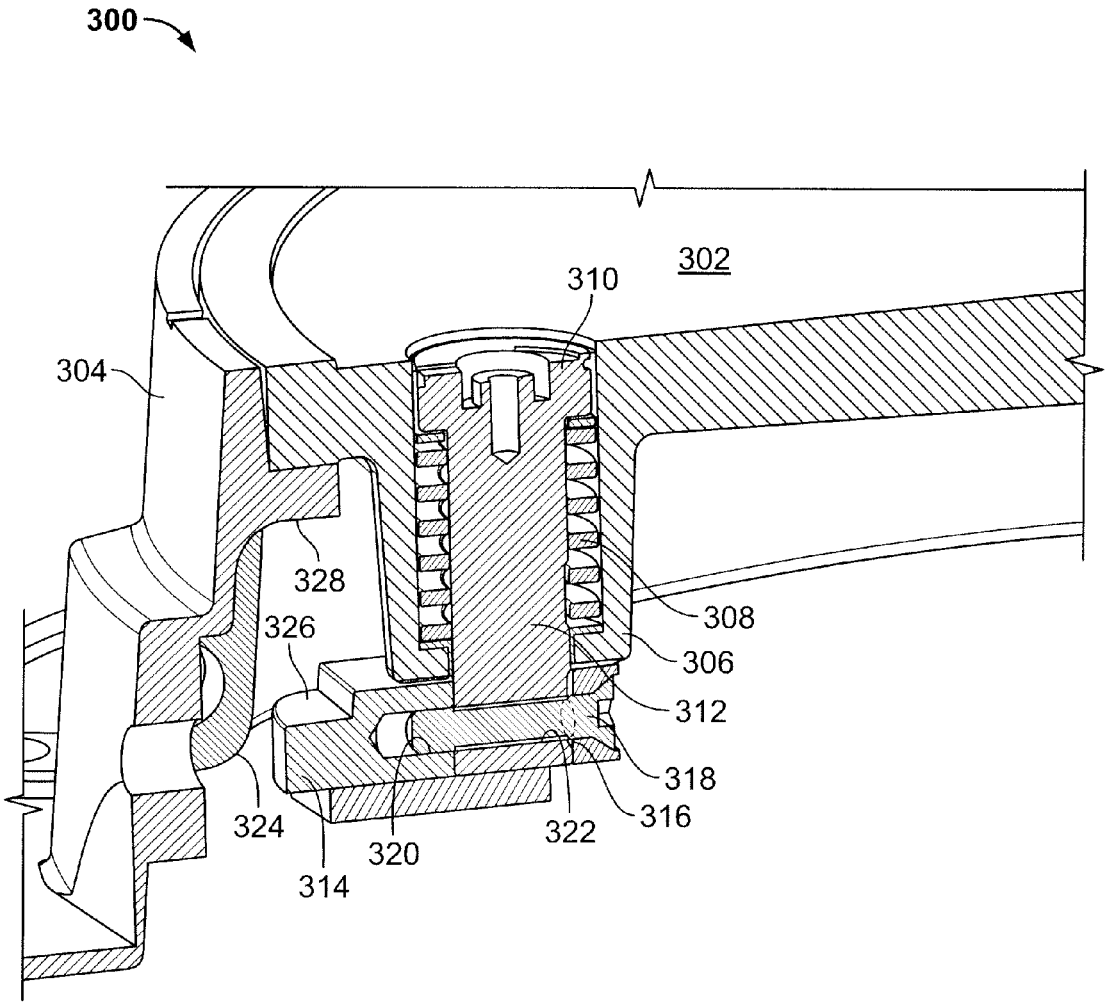
FIG. 10 is a partial cross-sectional view of a manhole cover assembly, according to an alternative embodiment.

FIG. 10 is a partial cross-sectional view of a manhole cover assembly 300 including a manhole cover 302 and a frame 304, according to an alternative embodiment. As shown in FIG. 10, a lug housing 306 is formed integrally within the manhole cover 302. A spring 308 is positioned within the lug housing 306, and a piston 310 is positioned within the lug housing 306, adjacent the spring 308. A rod 312 is connected to the piston 310, similar to that of the manhole cover assembly 100 as described above. A lug 314 is coupled to the rod 312. More specifically, the rod 312 extends through a longitudinal bore 316 of the lug 314. A transverse pin 318 extends into a transverse bore 320 of the lug 314, and through a complimentary bore 322 of the rod 312. The transverse pin 318 facilitates alignment of the lug 314 against an inner wall 324 of the frame 304.

In operation, a pressure-inducing event causes the manhole cover 302 to move outward relative to the frame 304 until a stop 326 of the lug 314 abuts a bottom surface 328 of the frame 304. Upon the lug 314 abutting the frame 304, the piston 310 is forced downward relative to the lug housing 306, thereby compressing the spring 308 and dissipating the energy of the moving manhole cover. When the pressure subsides, the spring 308 forces the manhole cover 302 back to its seated position.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled" and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. When the language "at least a portion" and/or "a portion" is used the item can include a portion and/or the entire item unless specifically stated to the contrary.

What is claimed is:

1. A manhole cover assembly, comprising:

a manhole cover movable between a seated position in which the manhole cover is supported on a seat of a manhole frame, and an unseated position in which the manhole cover is displaced relative to the seat of the manhole frame; and a latch assembly, including:

a latch shock absorber, including:

a latch housing fixedly coupled to the manhole cover, the latch housing defining a latch cylinder, a latch piston slidably coupled to the latch cylinder, a latch rod fixedly coupled to the latch piston, the latch rod extending through the latch housing, and a latch spring positioned within the latch cylinder adjacent the latch piston; and a latch fixedly coupled to the latch rod, the latch selectively rotatable relative to the latch housing between a locked position and an unlocked position, the latch extending radially outward relative to the manhole cover in the locked position so as to prevent the manhole cover from being removed from the manhole frame, wherein, in response to a pressure applied to the manhole cover, the latch assembly is configured to permit limited displacement of the manhole cover relative to the seat of the manhole frame, and to controllably dissipate energy relating to the pressure.

2. The manhole cover assembly of claim 1, wherein the latch assembly further comprises a latch mounting plate fixedly coupled to, and extending radially outward from, the latch housing, the latch mounting plate coupled to a bottom surface of the manhole cover so that the latch mounting plate is inaccessible from outside of a manhole into which the manhole cover is installed so as to prevent an individual from removing the latch assembly from the manhole cover.

3. The manhole cover assembly of claim 1, wherein the latch assembly further comprises an impact recording disc removably coupled to the latch piston, the impact recording disc structured to measure and record a severity of the pressure applied to the manhole cover.

4. The manhole cover assembly of claim 1, further comprising a roller coupled to the latch, the roller structured to facilitate removal of the manhole cover from the manhole frame.

5. The manhole cover assembly of claim 4, wherein the roller is structured to engage a surface to which the manhole frame is affixed so as to facilitate rolling movement of the manhole cover relative to the surface.

6. The manhole cover assembly of claim 1, wherein the manhole cover further comprises extractor rails extending from a bottom surface of the manhole cover, the extractor rails structured to engage an upper surface of the manhole frame to facilitate removal of the manhole cover from the manhole frame.

7. The manhole cover assembly of claim 1, further comprising a lug assembly fixedly coupled to the manhole cover, the lug assembly comprising:

a lug shock absorber, including:

a lug housing fixedly coupled to the manhole cover, the lug housing defining a lug cylinder, a lug piston slidably coupled to the lug cylinder, a lug rod fixedly coupled to the lug piston, the lug rod extending through the lug housing, and a lug spring positioned within the lug cylinder adjacent the lug piston, wherein, in response to the pressure applied to the manhole cover, the lug assembly is configured to permit limited displacement of the manhole cover relative to the seat of the manhole frame, and to controllably dissipate energy relating to the pressure.

8. The manhole cover assembly of claim 7, wherein the lug housing is formed integrally within the manhole cover.

9. The manhole cover assembly of claim 7, wherein the lug housing defines an angled surface slidably engageable with an upper surface of the manhole frame to facilitate removal of the manhole cover from the manhole frame.

10. A manhole cover latch assembly, comprising:

a latch shock absorber, including:

a latch housing structured to be fixedly coupled to a manhole cover, the latch housing defining a latch cylinder, a latch piston slidably coupled to the latch cylinder, a latch rod fixedly coupled to the latch piston, the latch rod extending through the latch housing, and a latch spring positioned within the latch cylinder adjacent the latch piston; and a latch fixedly coupled to the latch rod, the latch selectively rotatable relative to the latch housing between a locked position and an unlocked position, the latch extending radially outward relative to the manhole cover in the locked position so as to prevent the manhole cover from being removed from a manhole frame.

11. The manhole cover latch assembly of claim 10, wherein the latch assembly further comprises a latch mounting plate fixedly coupled to, and extending radially outward from, the latch housing, the latch mounting plate structured to be coupled to a bottom surface of the manhole cover so that the latch mounting plate is inaccessible from outside of a manhole into which the manhole cover is installed so as to prevent an individual from removing the latch assembly from the manhole cover.

12. The manhole cover latch assembly of claim 10, wherein the latch assembly further comprises an impact recording disc removably coupled to the latch piston, the impact recording disc structured to measure and record a severity of the pressure applied to the manhole cover.

13. The manhole cover latch assembly of claim 10, wherein the latch housing defines a first bore extending partially through the latch housing along a longitudinal axis of the latch housing, the first bore defining the latch cylinder, and wherein the latch housing further defines a second bore extending through the latch housing along the longitudinal axis, the second bore defining a latch passage, the latch rod extending through the latch passage, the latch passage having a first diameter slightly larger than a second diameter of the latch rod so as to facilitate rotation of the latch rod relative to the latch passage.

14. The manhole cover latch assembly of claim 13, wherein the latch defines a third bore extending through the latch along the longitudinal axis, the third bore structured to receive the latch rod, and wherein the latch further defines a forth bore extending partially through the latch along a transverse axis perpendicular to the longitudinal axis from an outer surface of the latch to the third bore, and wherein the manhole latch cover assembly further comprises a set screw extending through the fourth bore and into a recess defined by the latch rod so as to fixedly couple the latch to the latch rod.

15. The manhole cover latch assembly of claim 14, wherein the longitudinal axis is a first longitudinal axis, wherein the latch housing defines a detent groove on a bottom surface of the housing, and further defines first and second detents recessed further into the housing from opposite sides of the detent groove, wherein the latch defines a fifth bore extending along a second longitudinal axis, the second longitudinal axis parallel to the first longitudinal axis and spaced radially outward from the third bore, and wherein the latch further includes a detent pin extending through the fifth bore.

16. The manhole cover latch assembly of claim 15, wherein the first detent is structured to receive the detent pin when the latch is in the locked position, and wherein the second detent is structured to receive the detent pin when the latch is in the unlocked position.

17. The manhole cover latch assembly of claim 10, wherein the latch housing defines a cavity extending into the latch housing along the longitudinal axis from an outer surface of the latch housing, and wherein the latch piston includes a tamper-resistant boss formed on an end of the latch piston opposite the latch, the tamper-resistant boss structured to be positioned in the cavity of the latch housing.

18. The manhole cover latch assembly of claim 17, wherein the tamper-resistant boss is engageable only by a specialty tool so as to rotate the latch between the locked position and the unlocked position.

19. The manhole cover latch assembly of claim 10, further comprising a roller coupled to the latch, the roller structured to facilitate removal of the manhole cover from the manhole frame.

20. The manhole cover latch assembly of claim 19, wherein the roller is structured to engage a surface to which the manhole frame is affixed so as to facilitate rolling movement of the manhole cover relative to the surface.

* * * * *